United States Patent [19]

Kuhlman

[11] 4,437,868

[45] Mar. 20, 1984

[54] CONTROLLED EXHAUST SYSTEM FOR LOW TEMPERATURE ENCLOSURE

[76] Inventor: Ronald H. Kuhlman, N56 W21640 Silver Spring Rd., Menomonee Falls, Wis.

[21] Appl. No.: 381,031

[22] Filed: May 24, 1982

[51] Int. Cl.[3] ..... F25D 17/06

[52] U.S. Cl. ..... 62/411; 62/455; 98/116

[58] Field of Search ..... 62/409, 410, 411, 454, 62/455, 456; 98/116

[56] References Cited

U.S. PATENT DOCUMENTS

| | | | |
|---|---|---|---|
| 1,874,043 | 8/1932 | Ilg et al. | 98/116 |
| 2,673,514 | 3/1954 | Hanks | 98/116 |

*Primary Examiner*—Ronald C. Capossela
*Attorney, Agent, or Firm*—Andrus, Sceales, Starke & Sawall

[57] ABSTRACT

A cold storage enclosure for storing of food products includes a freezer using ammonia as the refrigerant. At least one exhaust unit is provided to exhaust the enclosure in the event of a break in the refrigeration equipment which releases damaging ammonia gases. The exhaust unit is mounted to a coupling chamber unit secured to the roof of the enclosure. The chamber unit includes a tubular insulating wall support with an insulated vapor proof bearier panel secured to the inner end and a damper unit secured in outwardly spaced relation to form a coupling chamber therebetween. An interconnecting linkage is located within the chamber with the linkage coupled to the damper and including a moving arm for forced removal of the bearier panel. A heater in the chamber holds the temperature above freezing to ensure positive operation of the damper even though moisture may accummulate in the chamber and on the operator and/or linkage.

15 Claims, 4 Drawing Figures

CONTROLLED EXHAUST SYSTEM FOR LOW TEMPERATURE ENCLOSURE

BACKGROUND OF THE INVENTION

This invention relates to a controlled exhaust system for low temperature enclosures such as a storage freezer and other enclosures held below freezing.

Enclosures to be held at low temperatures include a suitable freezing unit to lower the temperature. Commercially available freezer units use ammonia as the recircling heat exchange liquid. In large installations, such as cold storage rooms and warehouses for food, exhaust fan units are generally provided to exhaust the ammonia gaseous medium in the event of a break or leak in the recirculation system. Where the enclosure is to be held at or below a thirty-two degrees Fahrenheit (32° F.), the exhaust fan units are suitably dampered with a temperature barrier to isolate the refrigerated room from the surroundings. Refrigerant leakage within the low temperature enclosure may however result in contamination and practical destruction of the stored food product. If the exhaust fan system rapidly and effectively removes the gaseous ammonia. Such contamination has been encountered for example, in a number of large low temperature food warehouses even though equipped with exhaust means.

Thus, there is a need for a means responsive to a refrigerant leak to more positively remove the contaminating refrigerant gases so as to protect the stored product, such as food.

The present inventor discovered that the contamination generally results because of an exhaust system malfunction created by the low temperature environment.

SUMMARY OF THE INVENTION

The present invention is particularly directed to an improved exhaust fan system for low temperature enclosures, and particularly for such enclosure for food or like product which are subject to damage in the present of a contaminating gaseous medium such as a leaking refrigerant. Generally, in accordance with the present invention, an exhaust fan unit is secured to the enclosure with a temperature controlled vapor-proof barrier transfer and coupling chamber having means to open the barrier whenever the exhaust means is operative. The present invention is based upon the inventor's discovery that the less-than effective operation of exhaust systems is caused by freezing of the exhaust operating mechanism, such as the dampers, operators and the like. The problem arises after the installation because at the lower temperature of the enclosure environment, ice or frost is created within such exhaust system operating components and that such ice or frost often interferes with and hinders the effective desired operation of the exhaust fan system. In accordance with the present invention, the coupling chamber is provided with a heating means to maintain the operating mechanism at a controlled temperature which essentially avoids creation of interfering frost and ice in the operating mechanism.

More particularly, in accordance with a preferred construction and embodiment of this invention a coupling chamber is secured within an opening in the enclosure wall and includes a separable inner insulated, vapor-proof barrier wall means. A motor driven fan includes a damper means closing the outlet from the coupling chamber. An operator means is coupled to the damper and to a means to remove the separable barrier means. A heating means associated with the coupling chamber maintains the chamber at a temperature which prevents formation of frost or ice which can prevent the desired operation of the exhaust system when needed. The barrier means may be any suitable wall unit which can be rapidly and effectively removed, such as a breakable panel means, a replaceable panel member releasably secured in place with a vapor sealing medium or the like. The barrier panel means when in place of course insulates and seals the opening in the enclosure wall to prevent loss of the cold air or passage of heat from the coupling chamber into the enclosure.

In one practical embodiment of the invention, a mechanical lever unit is coupled to the damper motor operator and the separable barrier wall means. When the damper motor operator is energized, the damper opens simultaneously with the forced removal of the barrier wall means. In operation, the exhaust system is actuated either manually or automatically. When a refrigerant leak is detected, the exhaust system reliably opens to rapidly and effectively remove the contaminating gases, after which the motor operator closes the damper to substantially seal the outlet of the coupling chamber and thereby provide close the opening to the controlled environment. A barrier panel is placed over the interior of the coupling chamber to reset the exhaust system, and re-establish the controlled protective environment for the exhaust operating mechanism.

The present invention thus provides a reliable exhaust system for low temperature enclosures which is readily constructed with existing and available components to produce effective protection of stored products from contaminating gases.

DESCRIPTION OF THE DRAWING FIGURES

The drawing furnished herewith illustrates a preferred construction of the present invention in which the above advantages and features are clearly disclosed as well as others which will be readily understoood from the following description.

DESCRIPTION OF THE ILLUSTRATED EMBODIMENT

Figure 1:
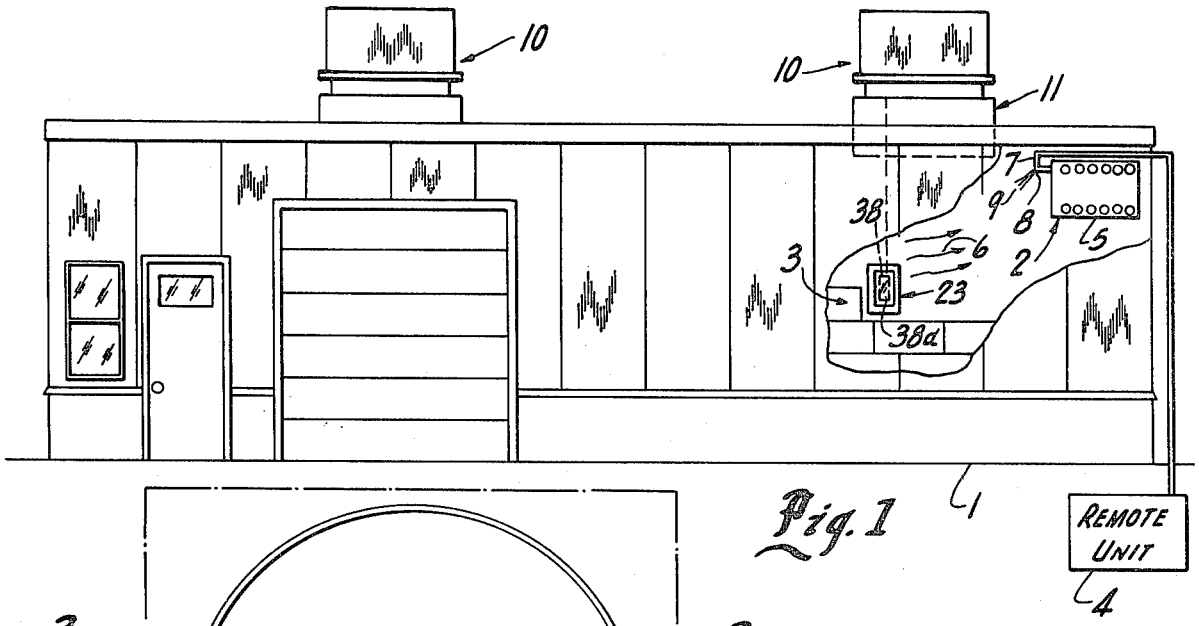
FIG. 1 is an elevational view of a low temperature storage building for food products, with parts broken away to show an installation of one embodiment of the present invention.

Referring to the drawing and particularly to FIG. 1, a cold storage building or enclosure 1, is shown having a freezer 2 circulating cold air within the building. Food products 3 are stored within the building 1, which may be a large warehouse for storage of various food products for distribution to retail outlets. Thus, the enclosure 1 is generically illustrative of any low temperature enclosure within which product is held at a temperature below freezing and often substantially below freezing. For example, food product storage may require maintaining the temperature at a −10° F. or below.

Figure 2:
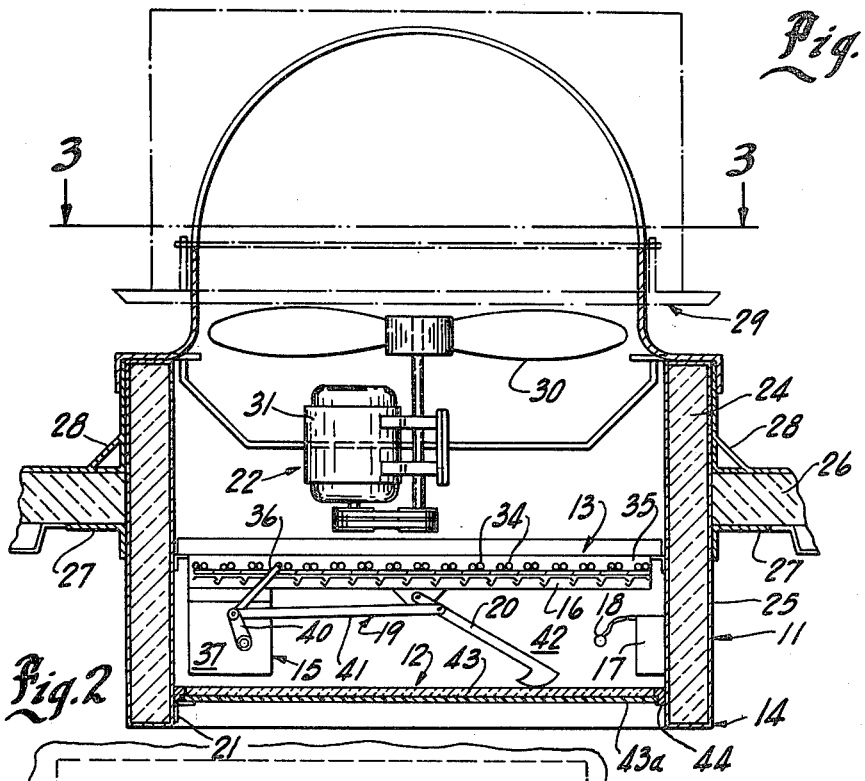
FIG. 2 is an enlarged vertical section through the exhaust unit shown in FIG. 1.
Figure 3:
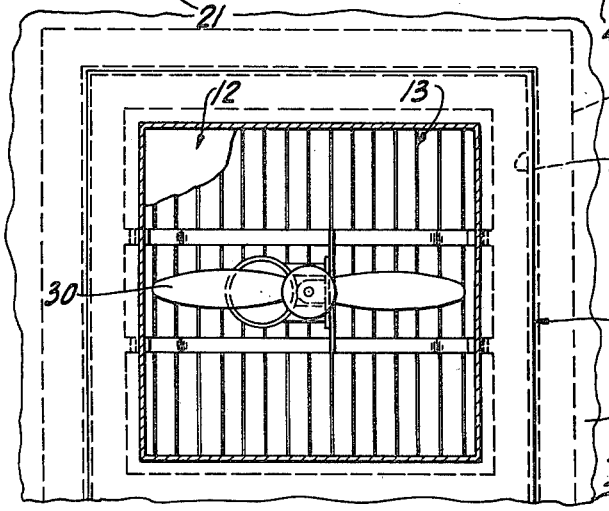
FIG. 3 is a bottom view of the exhaust unit shown in FIGS. 1 and 2.
Figure 4:
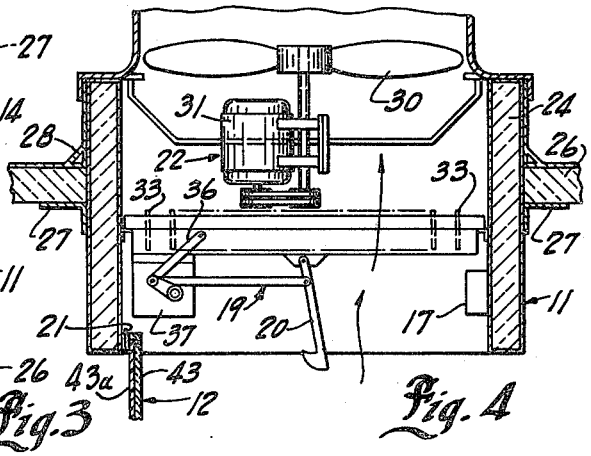
FIG. 4 is a reduced view similar to FIG. 2 showing the opening of an exhaust unit shown in FIGS. 1-3.

The freezer 2 typically includes a recirculated refrigerant passing through a sealed flow system including a remote heat extractor unit 4 for reducing the temperature of the refrigerant and a heat absorber unit 5 for cooling of air 6 supplied to the enclosure 1. The extractor unit 4 and absorber unit 5 are of course connected by suitable piping means 7. If any opening in the refrigerant flow passageway or piping occurs, such as an opening 8 in connecting piping 7 or elsewhere, the refrigerant escapes as a gaseous medium or product 9 which tends to be dispersed throughout the enclosure 1. Ammonia is universally used in large food storage freezers, cold storage rooms, cold storage food warehouses and the like. Gaseous ammonia rapidly adversely affects food products and thus must be rapidly removed. One or more exhaust units 10 are shown provided on the building roof to rapidly exhaust any such damaging gaseous product. One food mounted exhaust unit 10 is shown in detail in FIGS. 2–4 of the drawing and is specially constructed in accordance with the teaching of this invention to include an interposed controlled transfer or coupling chamber unit 11 between the interior of the enclosure 1 and the exterior ambient. The chamber unit 11 generally includes an inner insulated, vapor sealed barrier wall 12 and an outer opening or outlet covered by a damper unit 13 secured within a tubular support 14.

The damper unit 13 includes an operator 15 and a conventional multiple louvered damper 16 which is moved between an open position (shown in FIG. 4) and a closed position (shown in FIG. 2) for corresponding opening and closing of the outlet. In the normal standby position, the damper is closed to close the chamber 11 from the surrounding ambient.

In accordance with the illustrated embodiment of the present invention, a controlled heating unit 17 is provided in the chamber 11, preferably with a suitable control thermostat 18, to maintain the chamber at a minimum temperature level. For example, in a practical application, the chamber may be held at 40° F. The heating of the chamber 11 prevents the build-up of frost, ice or the like within the operating mechanism of the damper unit 13 and ensures proper and complete operation of the damper unit whenever it is to be opened to exhaust the gaseous medium from the enclosure. This, of course, requires the removal of the inner insulated vapor sealed barrier wall 12.

In the illustrated embodiment of the invention a barrier removing mechanism 19 is mounted within the chamber 11 and coupled to the damper operator 15 for simultaneous operation with the opening of the louvers 16. Thus, in the illustrated embodiment of the invention, mechanism 19 includes a removal arm 20 which is adapted to move downwardly into engagement with the barrier wall 12. The arm 20 is operable to remove the wall 12 and thereby the opening closed by the wall 12.

The barrier wall 12 may be formed of a breakable material which will be separated as the result of the movement of the lever arm 20 downwardly therethrough, and with the broken barrier wall dropping downwardly into the building. Alternatively, the barrier wall 12 may be formed as a single nonbreakable wall with a releasable sealed connection within the opening. The arm 20 would then positively force the barrier wall from the opening to open the inlet and thereby permit the removal of the gaseous medium. Such a fixed wall unit may be hingedly connected to the exhaust unit as by a hinge unit 21 for convenient storage and replacement after operation of the exhaust fan unit to remove the gaseous medium. Thus, wall 12 and operating mechanism 19 are generically illustrative of any means to provide a vapor-proof seal of the discharge opening in combination with a mechanism for removing of such barrier wall whenever the exhaust unit 10 is to be operative to remove the gaseous medium. The exhaust unit 10 includes a motor-driven fan unit 22 mounted within the outer end of the tubular support 14 and operably to withdraw air and any gaseous medium from within the enclosure, when wall 12 is removed and damper unit 13 is opened.

A control unit 23 is provided for selectively supplying of power to the motor-driven fan unit 22 and to the damper operator 15 for establishing power operation thereof.

In operation, whenever a damaging gaseous condition exists, the control unit 23 (outside of boom) is actuated to start the fan unit 22 and to actuate the damper operator 15 which thereby opens the damper 13 and removes the bearier wall 12. The fan unit 22 operates to rapidly and effectively remove all of the gaseous medium 9. The system can be relied upon because the heated coupling chamber 11 will maintain the operative condition of the damper operating mechanism 15 and the bearier wall removal means 19. After the gaseous medium 9 has been exhausted, the control unit 23 is reset to the deenergized position, thereby terminating the operation of the fan unit 22 and closing of the damper unit 13. A new barrier wall 12 can of course be placed in position at any convenient time, either immediately or within a short period thereafter.

More particularly, in the illustrated embodiment of the invention, the exhaust unit 10 includes the cylindrical support 14 which is shown formed with a suitable insulating material 24 such as 5 inches thick urethane secured within an outer fiberglass housing or shell 25. The tubular support 14 is secured within the roof structure 26. In the illustrated embodiment of the invention, a mounting flange 27 is secured to the exterior of the tubular support 14 and projects laterally into secured engagement with the roof structure 26. A suitable counterflashing 28 is secured between the roof and the adjacent exterior outer wall of the tubular support 11 to seal the roof opening therebetween.

The fan unit 22 includes a waterproof hood 29 mounted over the upper end of the support 14. The exhaust fan unit 22 is mounted within the upper end of the support 14 with the fan 30 located immediately outwardly of the support and within the weatherproof hood. Fan motor 31 is located in the upper portion of the support 14 immediately above the damper unit 13.

The damper unit 13 may be any suitable powered means and is shown as a normally closed motorized conventional damper structure having the plurality of individual louvers 33 pivotally mounted within a frame. The louvers 33 include pivot pins or shafts with one end secured in an actuating end plate 35. An operating or actuating arm 36 is secured to move the end plate and thereby rotate the pivot supports and the attached louvers 33. The operator 15 includes a damper motor 37 located immediately beneath the damper unit 13 within the lower portion of the support 14 and above and outwardly of the barrier wall 12. The damper motor 37 is coupled to rotate the lever arm 36. Energization of the motor 37 results in rotation of the lever arm 36 to move the damper to an open position. When the motor is de-energized, a spring and/or any other suitable return means oppositely rotates the lever arm 36 to close the damper unit 13. The damper motor 37 and the fan motor 31 are coupled to the control unit 23 for simultaneous interrelated operation.

The control unit 23 may include a manual switch 38 to permit manual control of the operation of the exhaust unit 10.

More particularly, the illustrated control unit 23 for a motor operated system would include a suitable switch means 38 for providing power to the several motor electrically operated systems or motors. The illustrated control unit 23 is a breakable glass covered enclosure with a manually operated switch 38 provided behind a glass cover 38*a*. This is a conventional emergency switch control, such as employed in various alarm system. Other electrical and pneumatic operating systems are of course known and the control unit could readily be adapted for such other systems. Thus, the control unit 23 is a general illustration of a control means for operating an exhaust means for removal of the building air borne product as well as actuating of a primary closure member in combination with a barrier wall structure removal means. The control unit 23 may also be provided with a suitable automatic gaseous medium monitor which controls automatic operation of the unit in response to the presences of a gaseous medium. The illustrated control unit 23 is thus also generically illustrative of either any suitable manual or any automatic control unit responsive to the gaseous condition, or any combination thereof.

The barrier wall removal mechanism 19 is shown as a mechanical linkage including a lever arm 40 secured to the damper motor shaft 37 for simultaneous rotation with the damper actuating arm 36. The barrier removal lever arm 20 is pivotally secured to the central underside of the damper unit 13 and is coupled to the rotating arm 40 by a connecting link 41. With the damper closed, the removal arm 20 is pivoted upwardly into the chamber 11 between the damper unit 13 and barrier wall 12. When the damper unit 13 is moved to the open position, the removal arm 20 is pivoted downwardly through the normal plane of the wall 12 and is operative to effectively remove the wall and opening of the inlet to the exhaust fan unit.

The barrier wall 12 may be formed as an insulated thermal panel which is particularly operative to isolate the low temperature environment within the enclosure 1 from the outside ambient and from the coupling chamber 11. For example the panel may be formed of a sheet of urethane material 43 with or without the interior provided with a suitable coating or cover 43*a*. The urethane material provides an effective insulation to prevent passage of heat from within the enclosure 1. The insulated wall or panel 12 is sealed to the interior of the tubular support 14 by a suitable sealing medium or compound 44 interposed between or at the edge of the panel 12 and the tubular support 14. For example, a highly effective vapor seal medium 44 is a viscene sealer with a caulking compound for effective retention of the sealant in position. Such a combination of an insulating panel 12 and sealant 44 provides a highly effective combination of temperature insulation and vapor seal.

The insulated barrier wall 12 thus effectively isolates the cold environment of the enclosure 1 from the chamber unit 11 and particularly the damper unit 13 and wall removal operating mechanism 19. The heating unit 17 is operative to maintain the chamber 42 at a temperature above freezing. The special structure thus essentially minimizes the movement and creation of moisture or vapor condensation within the operating mechanism 15 and 19. This insures reliable operation thereof when necessary. The sealed bearier wall also prevents migration or infiltration from the exterior ambient through the dampered opening into the controlled interior environment of the enclosure.

In summary, with the preferred illustrated embodiment of the invention, the support 14 and damper unit 13 is preassembled for mounting within the roof opening. The exhaust fan unit 22 is assembled with the unit and the barrier wall 12 suitably located within the tubular support 14. If a leak within the refrigeration system occurs, the operating personnel breaks the glasscover and actuates the switch 38 to provide electrical power to the exhaust fan unit 22 and the damper operator 15. The exhaust fan 22 begins to operate simultaneously with the opening of the louvers 33 and the movement of the breaking arm 20 downwardly through the wall 12 to open the inlet to the exhaust fan unit 22. The exhaust fan unit 22 rapidly operates to exhaust the enclosure environment with removal of the damaging gaseous medium 9. After the contamination removal, the exhaust system would of course be shut down by reset of switch 38. As a result, the fan unit 22 would shut off and the damper unit 13 would return to the normally closed position, and provide a substantial sealing of the opening through the tubular support 14. A new insulated barrier wall 12 would of course be installed with a sealant 44. The damper unit 13 provides a substantial closing of the tubular support. The barrier wall 42 may be replaced immediately at some later convenient time within one or two days after the initial operation of the exhaust system. Thus, after escape of a gaseous medium the principle concern will of course be re-establishing the cold storage condition.

With the present invention fan exhaust units can readily be provided for large storage warehouses and the like, with roof mounted, wall mounted or other similar ventilation systems operable to evacuate all of the contaminations within an hour or less. Such a prompt and effective response would for example ensure protection of millions of dollars of product normally stored in warehouses and the like.

The present invention thus provides a relatively inexpensive exhaust system of commercially available components which reliably exhaust a cold storage enclosure.

Various modes in carrying out the invention are contemplated as being within the scope of the following claims, particularly pointing out and distinctly claiming the subject matter which is regarded as the invention.

I claim:

1. An exhaust apparatus for a cold storage enclosure means having an exhaust opening comprising a coupling chamber unit adapted to be mounted in sealed relationship within said opening, said exhaust chamber unit having an exterior movable closure means adapted to be moved between an open and closed position and having an interior insulated barrier wall means defining a vapor sealed closure to the coupling chamber between the closure means and the barrier wall means, opening means in said chamber to actuate said closure means and to remove said barrier wall means, and a small heating means coupled to the chamber unit and operable with the closure means in the closed position to hold the temperature in said chamber at least at the temperature necessary to ensure operation of said opening means and said heating means constructed and arranged to permit essentially free flow of air from the enclosure.

2. The apparatus of claim 1 wherein said heating means includes means for controlling the heating means and maintaining the chamber at an essentially fixed temperature.

3. The apparatus of claim 1 wherein said chamber unit includes an outer side wall adapted to be secured in said opening, said barrier wall means is a panel including an insulation layer and a vapor sealing inner wall surface, said panel being located in the side wall and including an edge sealant to establish a vapor seal between the panel and the side wall.

4. An exhaust apparatus for a cold storage enclosure, comprising a coupling chamber secured within an opening in the enclosure, an exhaust means mounted to the coupling chamber for moving of air and other gaseous mediums from the enclosure, barrier wall means sealed within said coupling chamber to effectively isolate the interior of the enclosure from the exterior of the enclosure, a moveable closure member secured within the coupling chamber outwardly of the barrier wall means, heating means for maintaining the chamber at a selected operating temperature, an operating means operative to move the moveable closure member between an open position and a closed position and for moving of said barrier wall means from the coupling chamber for opening the coupling chamber to the enclosure and permits passage of air and other gaseous medium through the coupling chamber from within the enclosure and with said closure member in the open position.

5. The exhaust apparatus of claim 4 wherein said coupling chamber includes a tubular support mounted within an opening in the enclosure, said bearier wall means including a rigid insulated panel, a vapor sealant securing said panel within the inner end of said tubular suport, said operating means including a moving lever mounted in said chamber between said panel and closure member and operable to move said panel from tubular support.

6. The exhaust apparatus of claim 4 wherein said barrier wall means includes an insulated barrier panel located within the inner end of the tubular support and including a vapor seal between the edge of the barrier panel and said tubular support to essentially completely isolate the interior of the enclosure from the exterior of the enclosure at said tubular support.

7. The apparatus of claim 6 wherein said closure means is a multiple louvered damper unit secured within the tubular support in outwardly spaced relation to the barrier panel, a damper operator located within the chamber, means for removing said barrier wall located within said chamber, and said exhaust located within the outer end of the tubular support and operable to establish flow from the enclosure through the tubular support with the damper unit open and barrier wall removed.

8. The apparatus of claim 7 wherein said damper operator includes a motor located within said chamber, a linkage interconnecting the output of the motor to the damper unit, said means for removing said barrier wall including a removal arm movably mounted within the chamber to engage the barrier wall for removal thereof, and a second linkage connecting the output of the motor to the removal arm.

9. An exhaust apparatus for removal of contaminants such as ammonia gas from a cold storage enclosure comprising a tubular insulating support adapted to be mounted in sealed relation within an exhaust opening in the enclosure exterior wall structure, said insulating support projecting to the opposite sides of the enclosure wall structure, an insulated barrier wall located within the inner end of the tubular support and including a removable vapor seal between the edge of the barrier wall and the tubular support to essentially completely isolate the interior of the enclosure from the exterior of the enclosure at said tubular support, a multiple element damper unit secured within the tubular support in outwardly spaced relation to the barrier wall and defining a chamber therebetween, a damper operator located within the chamber and connected to position the elements of said damper unit, means for removing said barrier wall located within said chamber, heating means associated with said chamber and operable to maintain said chamber at a temperature above freezing, and an exhaust located within the outer end of the tubular support and operable to establish a predetermined flow through the tubular support with the damper unit open and barrier wall removed.

10. The apparatus of claim 9 wherein said damper operator includes a motor located within said chamber, a linkage interconnecting the output of the motor to the damper unit said means for removing said barrier wall including a removal arm movably mounted within the chamber to engage the barrier wall for removal thereof, and a second linkage connecting the output of the motor to the removal arm.

11. The apparatus of claim 9 or 10 wherein said heating means includes a thermostat means for controlling the heating means and maintaining the chamber at an essentially fixed temperature above freezing.

12. The apparatus of claim 11 wherein said tubular support consists of a single integrated insulation layer secured within a corresponding cylindrical rigid outer housing, said housing being secured in the opening of the enclosure wall and including an external seal to prevent movement of air between the opening and the tubular support.

13. The apparatus of claim 9 wherein said barrier wall means is a breakable member, and said means for removing said barrier wall means includes an arm coupled to said damper operator and operable to move into breaking engagement with said barrier wall means with the damper unit moved to the open position.

14. The apparatus of claim 9 wherein said barrier wall means includes a rigid insulated panel, means to pivotally support the panel on said support and said means to remove the panel includes an arm located within the chamber and coupled to the damper operator for forcing the panel to operationally pivot out the as the damper unit is opened.

15. In a cold storage enclosure for storing of food product and having a freezer using a refrigerant forming a contaminating gaseious into the exhaust chamber means in the wall of the enclosure, a movable means secured to the exterior of the chamber with means for positioning the closure means between an opened position and a closed position, an insulated barrier wall removably secured to the interior end of the chamber means, motorized means for positioning said movable closure means and for removing said barrier wall means for forcing of air from the interior of the enclosure to the exterior of the enclosure with said barrier wall means removed and said movable wall means in the opened position, and heating means in said chamber for holding the temperature in the chamber above freezing with the barrier wall means in place and the movable closure means closed.

* * * * *

UNITED STATES PATENT AND TRADEMARK OFFICE

CERTIFICATE OF CORRECTION

PATENT NO. : 4,437,868

DATED : March 20, 1984

INVENTOR(S) : RONALD H. KUHLMAN

It is certified that error appears in the above-identified patent and that said Letters Patent is hereby corrected as shown below:

Col. 7, line 36, Claim 5, Cancel "suport" and substitute therefor ---support---; Col. 8, line 49, Claim 14, After "out" delete "the"; Col. 8, line 53, Claim 15, Cancel "gaseious" and substitute therefor ---gaseous---; Col. 8, line 54, Claim 15, After "movable" insert ---closure---.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*